US006238256B1

(12) United States Patent
Freitag

(10) Patent No.: US 6,238,256 B1
(45) Date of Patent: May 29, 2001

(54) ARRANGEMENT FOR MOUNTING PROPULSION UNIT TO BOAT HULL

(75) Inventor: Michael W. Freitag, Kenosha, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/470,960

(22) Filed: Dec. 22, 1999

(51) Int. Cl.[7] ..... B63H 11/00
(52) U.S. Cl. ..... 440/38; 440/46
(58) Field of Search ..... 440/38, 40, 41, 440/42, 43, 46

(56) References Cited

U.S. PATENT DOCUMENTS

| | | | | |
|---|---|---|---|---|
| 3,109,407 | | 11/1963 | Dorst | 115/14 |
| 3,572,281 | | 3/1971 | Becker | 115/37 |
| 5,254,024 | * | 10/1993 | Kobayashi et al. | 440/38 |
| 5,752,864 | | 5/1998 | Jones et al. | 440/41 |
| 5,967,868 | * | 10/1999 | Ito et al. | 440/38 |

FOREIGN PATENT DOCUMENTS

| | | |
|---|---|---|
| 262306 | 5/1963 | (AU) . |
| 481788 | 1/1970 | (CH) . |
| 1321564 | 2/1963 | (FR) . |
| 724662 | 11/1966 | (IT) . |

* cited by examiner

*Primary Examiner*—Stephen Avila
(74) *Attorney, Agent, or Firm*—Dennis M. Flaherty

(57) ABSTRACT

An arrangement for mounting a water jet apparatus to a hull of a marine craft. The hull has generallly horizontal and vertical sections and sidewalls which define a cavity in which an inlet housing of the water jet apparatus is installed. The inlet housing has a top section which abuts an exterior surface of the horizontal hull section and a front section which abuts an exterior surface of the vertical hull section. A top mounting plate abuts an interior surface of the horizontal hull section, while a front plate abuts an interior surface of the vertical hull section. One set of fasteners hold the top mounting plate, the horizontal hull section and the top section of the inlet housing together. Another set of fasteners hold the front plate, the vertical hull section and the front section of the inlet housing together.

25 Claims, 11 Drawing Sheets

ARRANGEMENT FOR MOUNTING PROPULSION UNIT TO BOAT HULL

FIELD OF THE INVENTION

This invention generally relates to water jet apparatus for propelling boats and other marine craft. In particular, the invention relates to means for mounting a water jet apparatus to the hull of a boat.

BACKGROUND OF THE INVENTION

It is known to propel a boat or other watercraft using a water jet apparatus mounted to the hull, with the powerhead being placed inside (inboard) the hull. The drive shaft of the water jet apparatus is coupled to the output shaft of the inboard motor. The impeller is mounted on the drive shaft and housed in a jet propulsion pipe or water tunnel.

To facilitate use of water jet-propelled boats in shallow water, it is known to mount the water jet at an elevation such that the water jet does not project below the bottom of the boat hull. This can be accomplished, for example, by installing a duct in the stern of the boat, the duct being arranged to connect one or more inlet holes formed in the bottom of the hull with an outlet hole formed in the transom. The water jet is then installed outside the hull in a position such that the water jet inlet is in flow communication with the duct outlet at the transom. Such a system is shown in Australian Patent Specification No. 262306, published in 1963. Alternatively, the water jet can be installed inside the duct built into the hull, as shown in U.S. Pat. No. 5,181,868.

In another type of design, a water jet apparatus is installed inside the hull and penetrates the transom. An inlet housing of the water jet has a horizontal opening and an inclined water tunnel for guiding water to the impeller. The horizontal opening of the inlet housing is mounted in a hole in the bottom or near the bottom of the hull. A similar design is disclosed in Swiss Patent No. 481788.

In many water jet units powered by inboard engines, the drive shafts and pump mountings (which must penetrate the hull) are placed below the waterline. This mounting system has the disadvantage that various gaskets and seals are required to ensure the integrity of the installation. Leakage at any of the mounting and shafting locations can be disastrous.

There is a need for a boat design which would allow a water jet apparatus to be mounted to a hull with penetrations for the drive shaft and shift and steering control system. The area of these penetrations through the hull should be minimized. In addition, the mounting arrangement should allow for easier installation than is the case with the above-described prior art mountings.

SUMMARY OF THE INVENTION

The present invention is directed to an arrangement for mounting a water jet apparatus to a hull of a boat or other marine craft. In accordance with the preferred embodiment, the hull has a cavity defined by a generally horizontal section, a generally vertical section connected to the horizontal section and a pair of side walls connected with the horizontal and vertical sections. An inlet housing of the water jet apparatus is installed in the cavity. The inlet housing has a bore in which the drive shaft is rotatably supported. The drive shaft is coupled to an output shaft of an inboard motor via an opening in the generally vertical hull section at the front of the cavity.

In the installed state, a top section of the inlet housing abuts an exterior surface of the horizontal hull section and a front section of the inlet housing abuts an exterior surface of the generally vertical hull section. The front section of the inlet housing is attached to the generally vertical hull section by means of a front plate which abuts the interior surface of the latter. The top section of the inlet housing is attached to the horizontal hull section by means of a top mounting plate which abuts an interior surface of the horizontal hull section. One set of fasteners hold the top mounting plate, the horizontal hull section and the top section of the inlet housing together. Another set of fasteners hold the front plate, the generally vertical hull section and the front section of the inlet housing together.

In accordance with the preferred embodiment of the invention, the front plate has an opening which communicates with a first cavity in the front section of the inlet housing via the aforementioned opening in the generally vertical hull section. The front end of the drive shaft resides in this first cavity in the inlet housing. The openings in the front plate and the generally vertical hull section allow the drive shaft to be coupled to the output shaft of the inboard motor. The front face of the front section of the inlet housing has an endless recess disposed along a closed curve which encompasses the first cavity. A seal is placed in this recess to minimize leakage of water through the opening in the generally vertical hull section. The fasteners for attaching the inlet housing to the generally vertical hull section reside within the ambit of the seal.

Further in accordance with the preferred embodiment of the invention, the top mounting plate is penetrated by the shift and steering control system. In particular, the top mounting plate has an opening which communicates with a second cavity in the top section of the inlet housing via an opening in the horizontal hull section. A shift and steering control housing, which rotatably supports the shift and steering shafts, is seated in the second cavity and penetrates the openings in the horizontal hull section and in the top mounting plate. The top face of the top section of the inlet housing has an endless recess located along a closed curve which encompasses the second cavity. A seal is placed in this recess to minimize leakage of water through the opening in the horizontal hull section.

In accordance with a further aspect of the preferred embodiment, the shift and steering cable assemblies, which are respectively connected to shift and steering shafts via upper shift and steering levers, are supported at respective heights above the top mounting plate by respective mounting brackets. These mounting brackets extend upward from and are integrally connected to the top mounting plate.

DETAILED DESCRIPTION OF THE PREFERRED EMBODIMENTS

Figures 1, 1A:
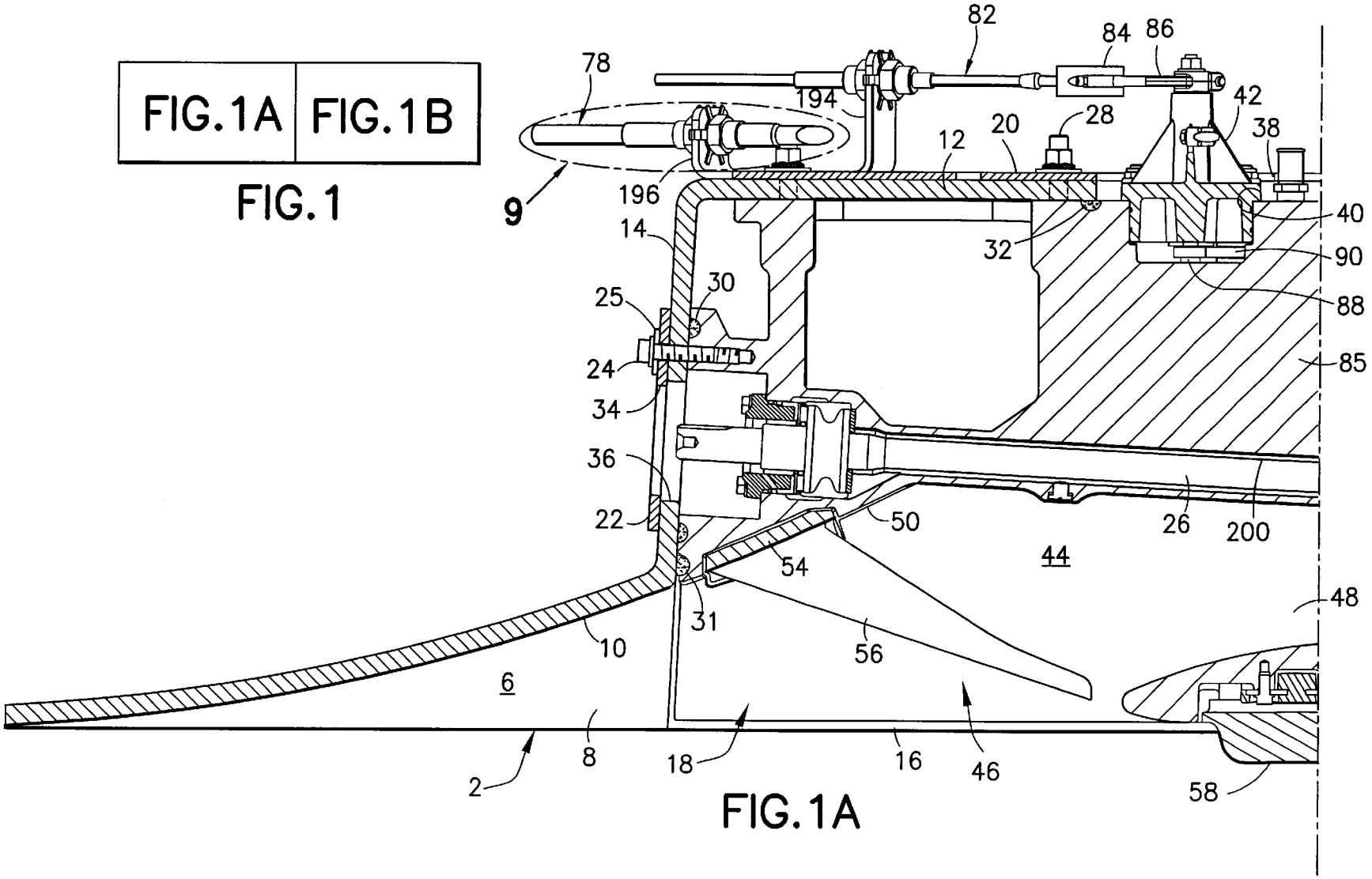
FIG. 1 is a schematic (presented on two sheets respectively labeled FIGS. 1A and 1B) showing a sectional view of a water jet apparatus mounted to a boat hull in accordance with a preferred embodiment of the invention, the section being taken along a vertical midplane.

The water jet apparatus shown in FIG. 1 is designed to be installed in a cavity under a section of the hull and in flow communication with the outlet of an inlet ramp built into the hull. As seen in FIG. 1, the boat hull 2 has an inlet ramp 6 formed by a pair of opposing sidewalls 8 and a ramp surface 10 which curves gently upward in the aft direction. The end of the inlet ramp 6 is in flow communication with a cavity in which the water jet apparatus is installed. This cavity for the water jet apparatus is defined by a horizontal hull section 12, a nearly vertical hull section 14 and a pair of opposing sidewalls 16 (only one of which is visible in FIG. 1), the cavity being open at the bottom and rear for allowing insertion of the water jet apparatus.

The water jet apparatus comprises an inlet housing 18 which is slid into the aforementioned cavity and bolted to the hull by means of a top mounting plate 20 and a front plate 22. At the time of inlet housing installation, the drive shaft 26 is already rotatably mounted in the inlet housing. In particular, the inlet housing 18 comprises a vertical strut 85 having an axial bore 200 which houses a portion of the drive shaft. The drive shaft 26 is rotatably supported by bearings. The bearing assembly at the front end of the drive shaft 26 is housed in a bearing housing 202. The bearing housing 202 is fastened to the inlet housing by a plurality of screws which are screwed into threaded holes 204 (seen only in FIG. 3) in the inlet housing 18.

The front of the inlet housing 18 is attached to the vertical hull section 14 by means of a front plate 22 and a plurality of screws 24 (only one of which is visible in FIG. 1). The numeral 25 in FIG. 1 denotes a washer placed between the head of screw 24 and the front plate 22. The front plate 22 has an opening 34 (best seen in FIG. 2) which, in the assembled state, is aligned with an opening 36 in the vertical hull section 14 to allow the output shaft (not shown) from the inboard motor to be coupled to the front end of the drive shaft 26. The top of the inlet housing is attached to the horizontal hull section 12 by means of a top mounting plate 20 and a plurality of studs 28.

Figure 3:
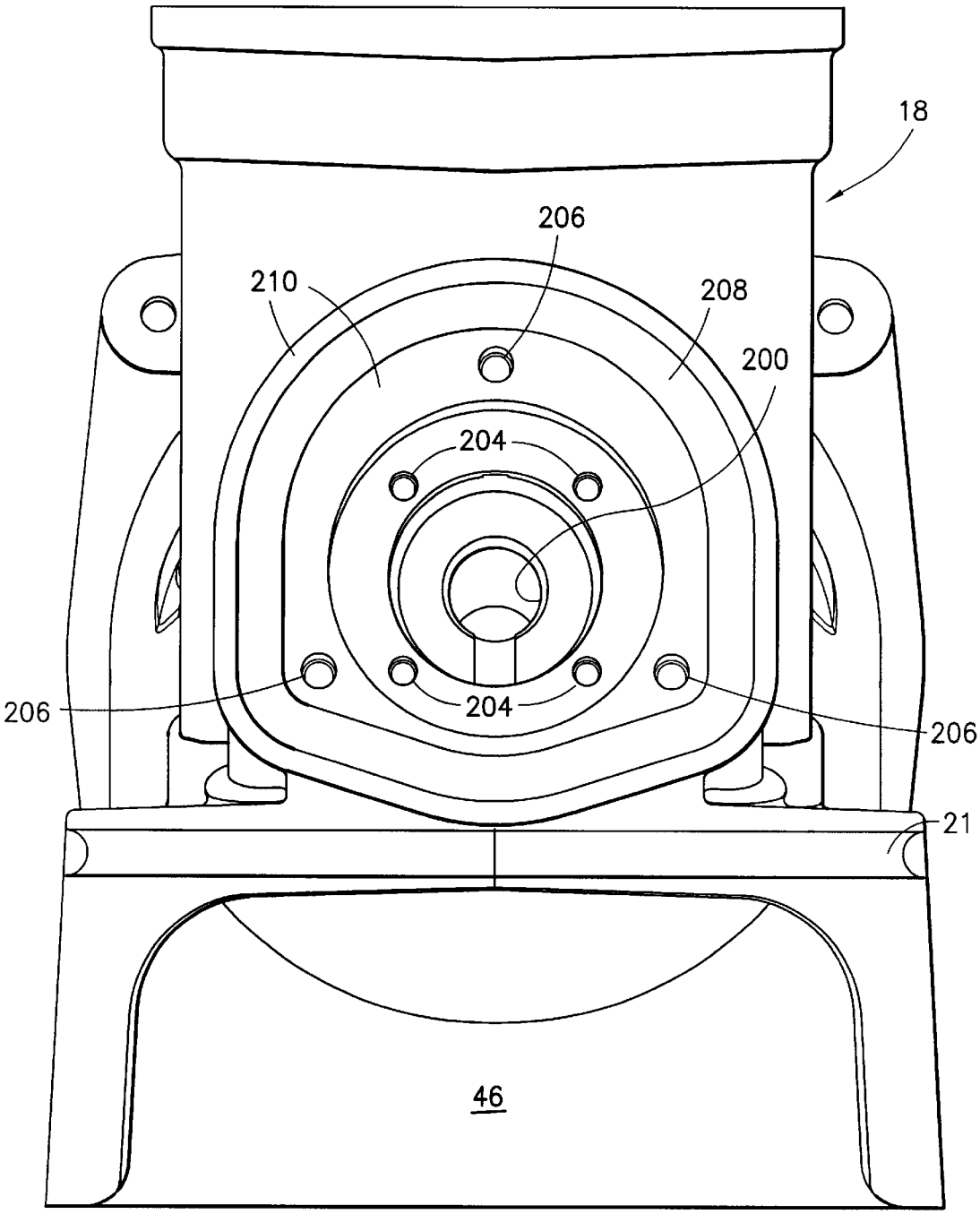
FIG. 3 is a schematic showing a front view of the inlet housing in accordance with the preferred embodiment of the invention.
Figure 4:
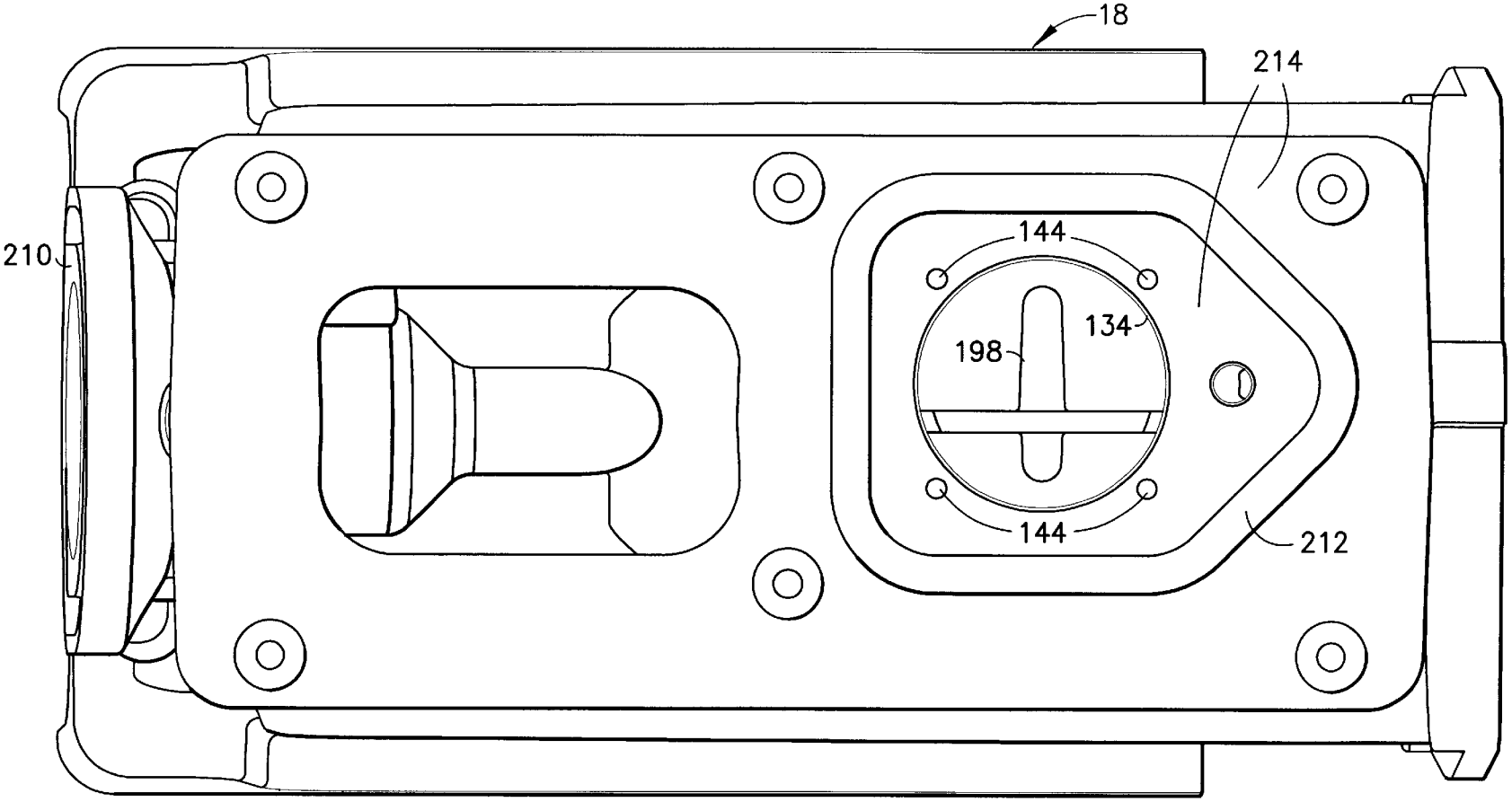
FIG. 4 is a schematic showing a top view of the inlet housing in accordance with the preferred embodiment of the invention.

In the assembled position, a front portion of the inlet housing 18 is sealed against the vertical hull section 14 by means of a seal 30 and a top portion of the inlet housing 18 is sealed against the horizontal hull section 12 by means of a seal 32. The seal 30 sits in an endless recess 208 having a closed contour and formed in the slightly inclined front face 210 of the inlet housing, as seen in FIG. 3. The seal 30 encompasses the interface where the openings in the vertical hull section 14 and inlet housing for the drive shaft 26 meet and is designed to prevent water leaking into the drive shaft assembly or into the boat via the opening 36. Similarly, the top mounting plate 20 has an opening 38 which, in the assembled state, is aligned with an opening 40 in the horizontal hull section 12 to allow a shift and steering control housing 42 to be placed in a corresponding opening in the top wall of the inlet housing 18. The seal 32 sits in an endless recess 212 having a closed contour and formed in the horizontal top face 214 of the inlet housing, as seen in FIG. 4. The seal 32 encompasses the interface where the openings in the horizontal hull section 12 and inlet housing for the shift and steering housing 42 meet and is designed to prevent water leaking into the boat via the opening 38. In addition, a seal 31 is pressed between the inlet housing 18 and the hull along the front and sides of the inlet housing. The seal 32 sits in a recess 21 having a straight section formed in the front of the inlet housing 18, as seen in FIG. 3, and having contoured sections (not shown) on the sides of the inlet housing.

The inlet housing 18 has a water tunnel 44 with an inlet 46. The water tunnel 44 has a pair of sidewalls 48 (only one of which is shown in FIG. 1) which are generally coplanar with the sidewalls 8 of the hull inlet ramp 6. In addition, the water tunnel 44 has a guide surface 50 which starts at a point near where the ramp surface 10 of the hull inlet ramp 6 ends and then curves gradually upward in the aft direction. As a result of the foregoing structure, there is a generally smooth transition between the end of inlet ramp 6 and the beginning of water tunnel 44. Thus the hull 2 and the inlet housing 18 combine to form a single inlet for guiding water toward the inlet of a stator housing 52 located downstream of the inlet housing.

An inlet grate 54 extends across the inlet 46 of the water tunnel 44 and serves to block the admission of debris into the water jet apparatus. The inlet grate 54 comprises a multiplicity of generally parallel tines 56 which extend downward and rearward from an upper end of the inlet grate. Only the upper end of the inlet grate is attached to the inlet housing by screws (not shown). The cantilevered design is based on the theory that any weeds that wrap around the grate will be drawn down to the lower, open end and slide of f under the boat and/or be drawn into the pump and chopped up. In addition, a ride plate 58 is attached to the bottom of the inlet housing 18.

Figure 1B:
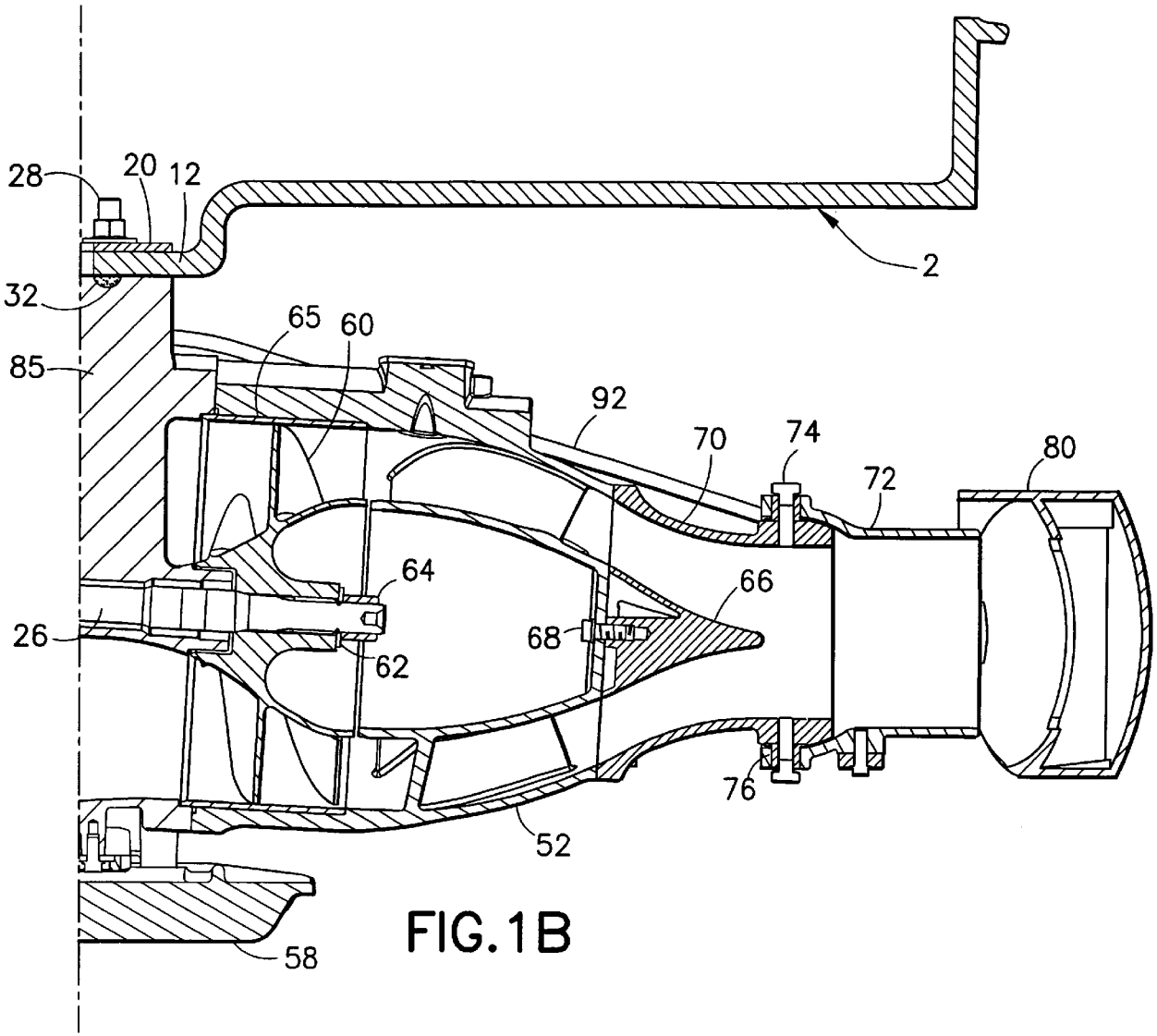

As shown in FIG. 1, the drive shaft projects in the aft direction out of the inlet housing 18. The impeller is pre-assembled in the unit prior to mounting in the hull. The hub and blades of impeller 60 are integrally formed as one cast piece. The hub of impeller 60 has a splined bore which meshes with splines formed on the external surface of the drive shaft 26, so that the impeller 60 will rotate in unison with the driveshaft. Also, a taper on the impeller locks on to a taper on the driveshaft to hold the impeller in place (see FIG. 3). The impeller 60 is held securely on the drive shaft 26 by a washer 62 (best seen in FIG. 1B), which in turn is held in place by a lock nut 64 tightened onto a threaded end of the drive shaft 26. As seen in FIG. 1B, the hub of the impeller 60 increases in radius in the aft direction, transitioning gradually from a generally conical outer surface at the leading edge of the impeller hub to a generally circular cylindrical outer surface at the trailing edge of the impeller hub. This outer surface of the impeller hub forms the radially inner boundary for guiding the flow of water impelled by the impeller.

The stator housing 52 comprises inner and outer shells connected by a plurality of stator vanes, all integrally formed as a single cast piece. The hub of the stator housing 52 gradually decreases in radius in the aft direction, starting out at a radius slightly less than the radius at the trailing edge of the impeller hub. The stator vanes are designed to redirect the swirling flow out of the impeller 60 into non-swirling flow. The stator housing hub has a radial end face with a central throughhole. Before the stator housing is installed, a tail cone cover 66 is attached to the radial end face of the stator housing hub by a screw 68. The front of the stator housing 52 is then attached to the rear of the inlet housing 18 by a plurality of screws (not shown in FIG. 1).

A circumferential recess in the stator housing 52 at a position opposing the impeller blade tips has a circular cylindrical wear ring 65 seated therein. Wear to the impeller blade tips is mainly due to the pumping of abrasives such as beach sand. The purpose of the wear ring 65 is to protect the soft aluminum casting with a hard stainless steel surface, thus drastically reducing the rate of wear.

After the stator housing 52 (with attached tail cone cover 66) has been attached to the inlet housing 18, the front of an exit nozzle 70 is attached to the rear of the stator housing 52 by screws. The front faces of the tail cone cover 66 and the exit nozzle 70 are preferably coplanar. The water flowing out of the stator housing 52 will flow through the space between the tail cone cover 66 and the exit nozzle 70, and then will exit the exit nozzle at its outlet.

Figure 2A:
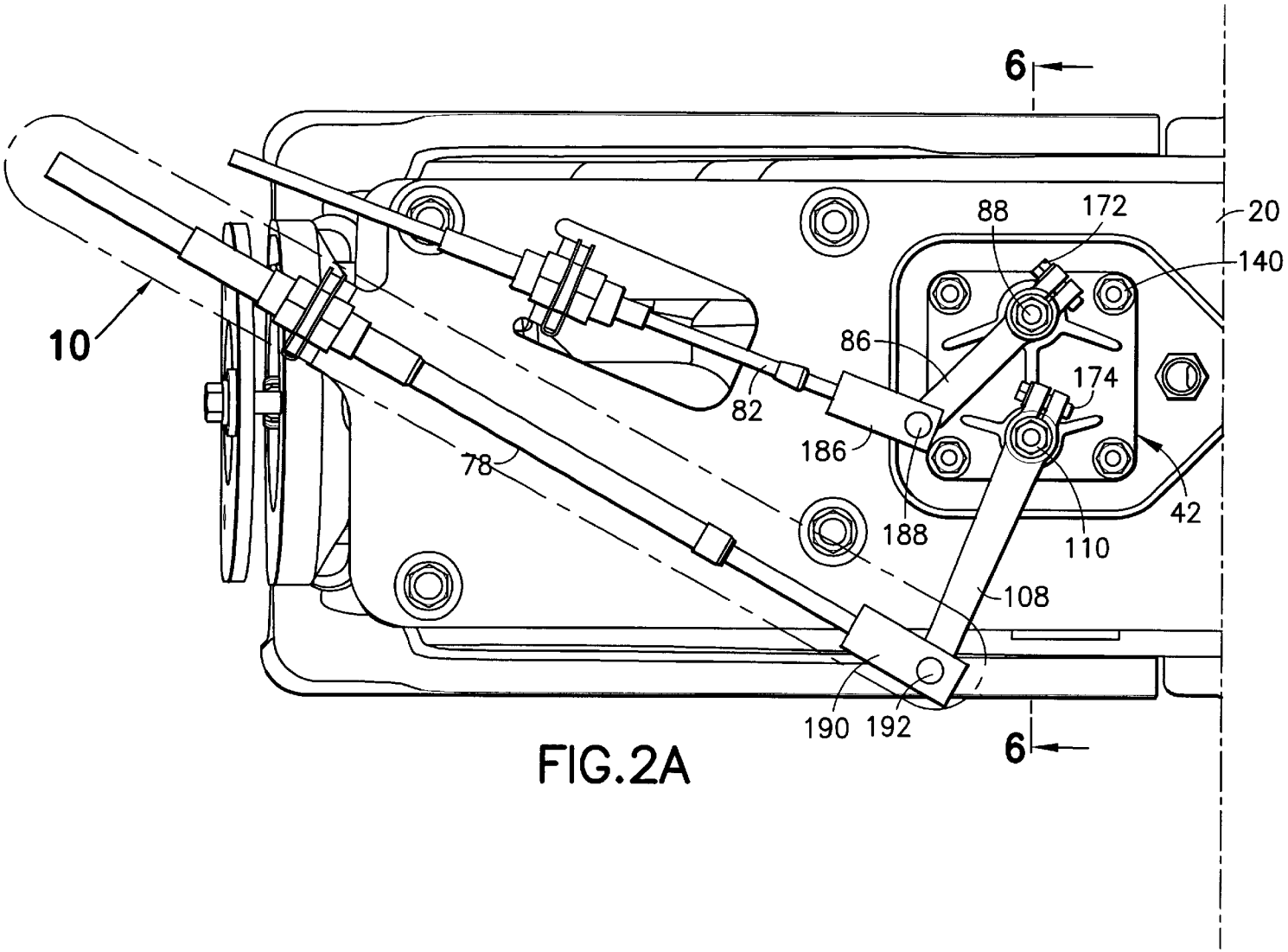
FIG. 2 is a schematic (presented on two sheets respectively labeled FIGS. 2A and 2B) showing a top view of the top mounting plate and the water jet apparatus depicted in FIG. 1, with the hull removed.
Figure 2B:
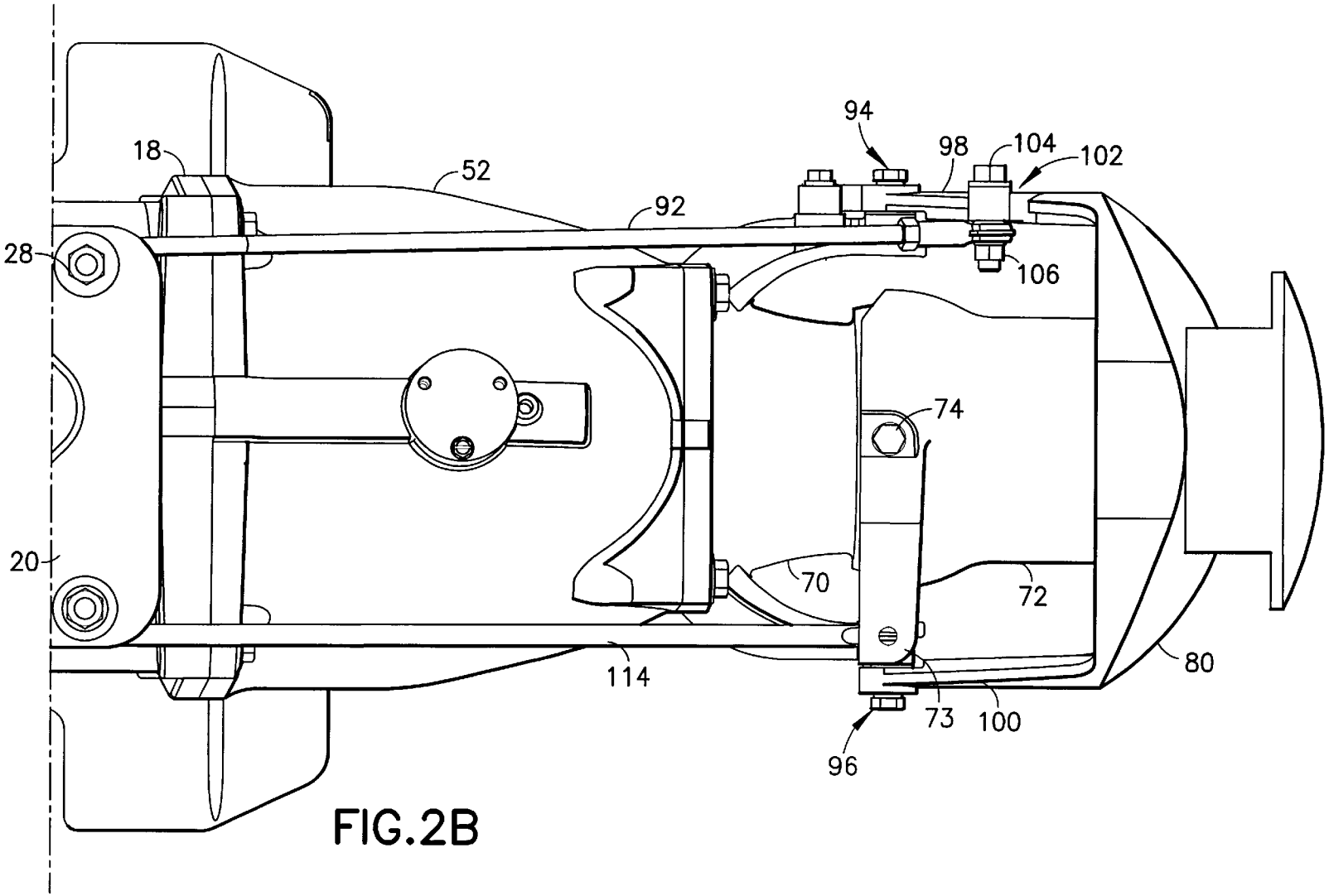

The water jet apparatus shown in FIG. 1 is provided with a steering nozzle 72 which can change the direction of the water exiting the exit nozzle 70. This effect is used by the boat operator to steer the boat left or right. To accomplish this, the steering nozzle 72 is pivotably mounted to the exit nozzle 70 by a pair of pivot assemblies located at the top and bottom of the exit nozzle. Each pivot assembly comprises a screw 74, a sleeve (not visible in FIG. 1) and a bushing 76. The axes of the screws 74 are collinear and form a vertical pivot axis about which the steering nozzle 72 can rotate. In particular, the steering nozzle has a pair of circular holes in which the bushings 76 are seated. The sleeves are inserted inside the respective bushings 76. The screws 74 are in turn inserted in the sleeves and screwed into respective threaded holes in the exit nozzle 70. As best seen in FIG. 2B, the steering nozzle 72 has an arm 73 which is pivotably coupled to a flattened end of a steering rod 114. Displacement of the steering rod 114 in response to operation of a steering cable assembly 78 (see FIG. 2A) causes the steering nozzle to swing a desired direction about its vertical pivot axis.

The water jet apparatus shown in FIG. 1 is also provided with a non-steerable reverse gate 80 which is pivotable between forward and reverse positions. In the forward position, the reverse gate 80 is raised, thereby allowing water to exit the steering nozzle 72 freely. In the reverse position, the reverse gate 80 is lowered to a position directly opposite to the outlet of the steering nozzle 72. The reverse gate is designed to partially reverse the flow of water exiting the steering nozzle 72 when the reverse gate is in the reverse position. This reverse flow of water will urge the boat in the aft direction. To accomplish the foregoing, the reverse gate 80 is pivotably mounted to the exit nozzle 70 by a pair of pivot assemblies 94 and 96 located on opposite sides of the exit nozzle (see FIG. 2B). Each pivot assembly 94 and 96 has a construction substantially identical to the pivot assemblies previously described with reference to pivoting of the steering nozzle 72. As seen in FIG. 2B, the reverse gate has a pair of arms 98 and 100, the ends of which are pivotably coupled to the respective pivot assemblies 94, 96. The reverse gate 80 is pivoted by a shift rod 92, the end of which is coupled to arm 98 of the reverse gate 80 by means of a rod end assembly 102 which comprises a ball socket for allowing horizontal radial motion at the shift lever and vertical radial motion at the reverse gate. The rod end assembly is attached to arm 98 by means of a screw 104 and a lock nut 106. Displacement of the shift rod 92 in response to operation of a shift cable assembly 82 (see FIG. 2A) causes the reverse gate to swing in a desired direction, namely, into forward position or reverse position. The reverse gate has a design which allows the boat to steer in reverse in the same direction like an outboard, stern drive or car.

Figure 5:
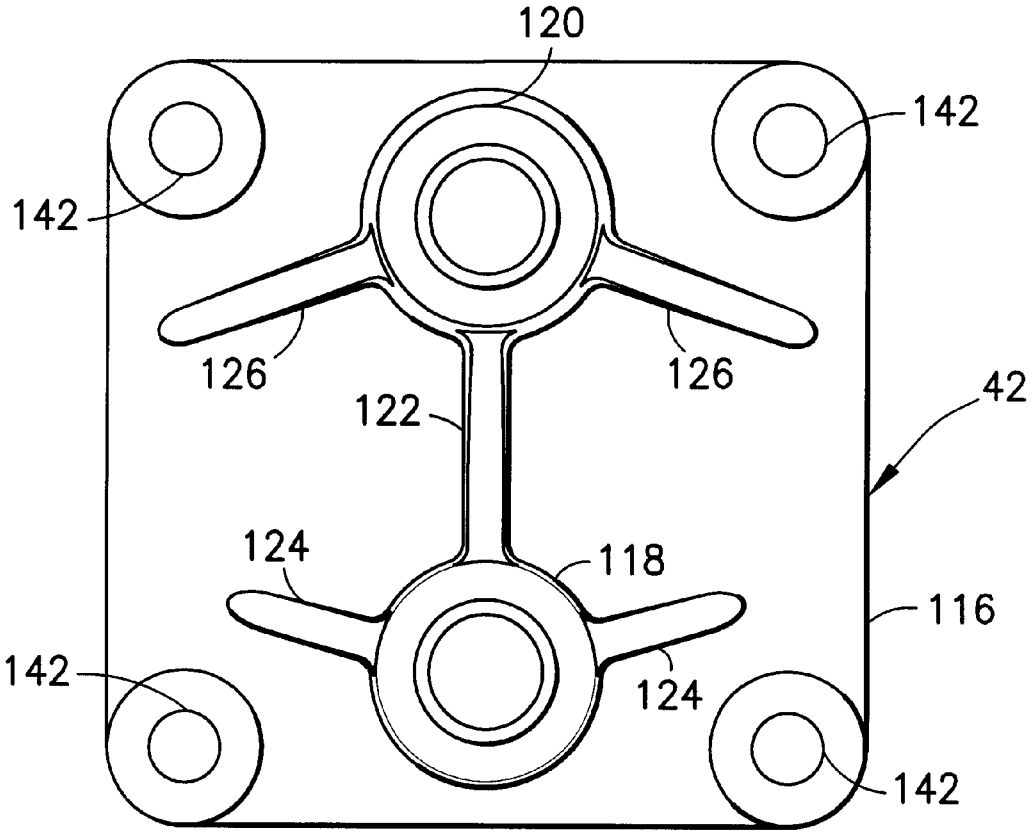
FIGS. 5, 7 and 8 are schematics showing top, side and bottom views of the shift and steering control housing.
Figure 7:
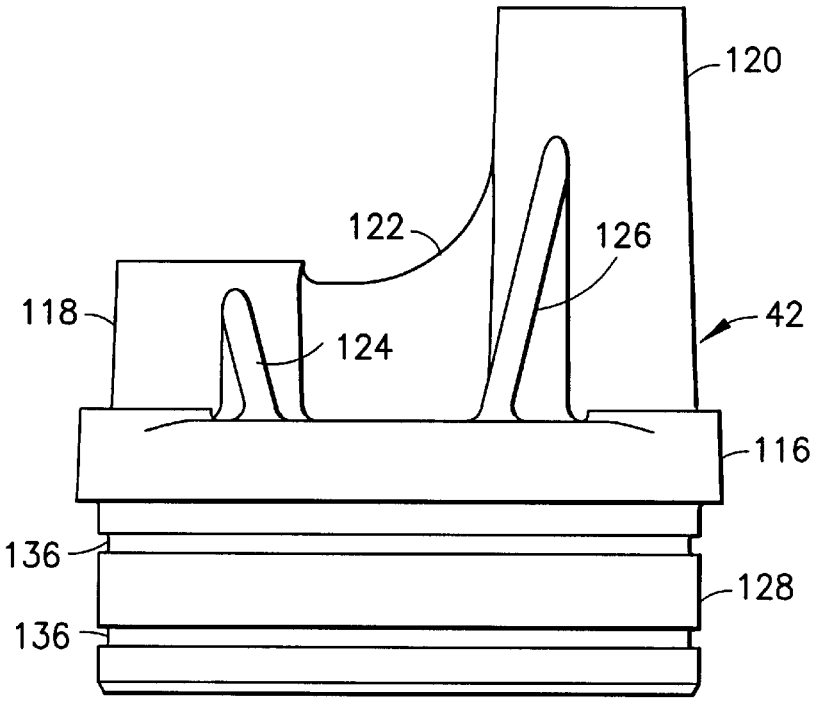
Figure 8:
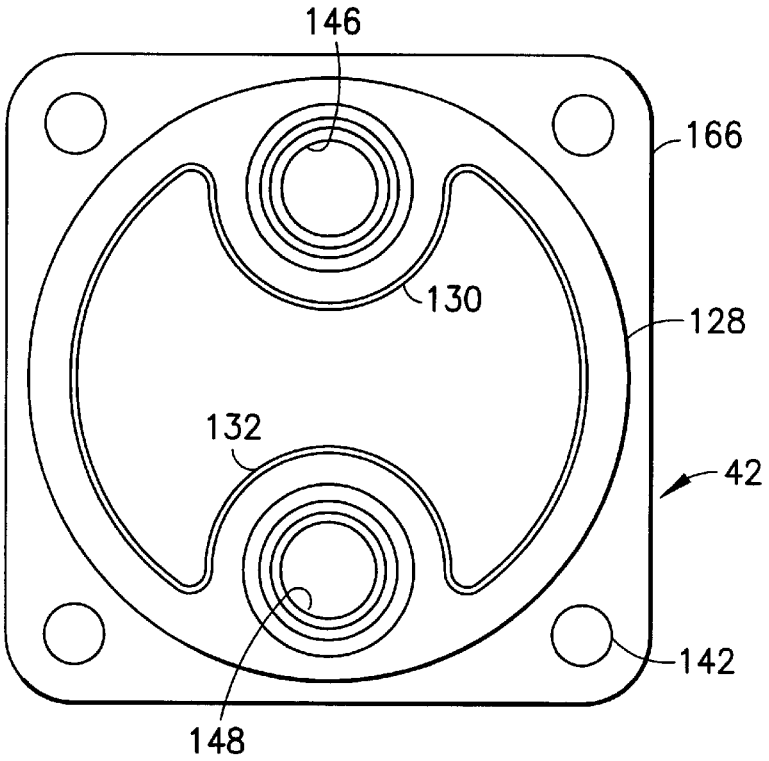

In accordance with the preferred embodiment of the invention, the shift and steering cable assemblies located inside the hull are respectively coupled to the shift and steering rods located outside the hull by means of respective lever and shaft assemblies rotatably supported in a shift and steering control housing 42 which is installed in a corresponding opening in the top of the inlet housing 18. As best seen in FIGS. 5 and 7, the housing 42 preferably comprises a base plate 116, an upper vertical tubular structure 118 integrally formed with base plate 116 and extending above it to a first height, and an upper vertical tubular structure 120 integrally formed with base plate 116 and extending above it to a second height greater than the first height. The tubular structures 118 and 120 are reinforced by a rib 122 extending therebetween and integrally formed therewith and with the base plate 116. Additional reinforcement is provided by respective pairs of ribs 124 and 126. As seen in FIG. 5, the base of housing 42 has a generally square shape with rounded corners. Below the base plate, the housing has a circular cylindrical lower wall 128 (shown in FIGS. 7 and 8), integrally formed with lower vertical tubular structures 130 and 132. The lower wall 128 slides into a circular opening 134 (shown in FIG. 4) formed in the top wall of the inlet housing 18. The opening 134 in the inlet housing communicates with the exterior of the water jet apparatus via a pair of opposing side channels through which the lower shift and steering levers (described below) respectively pass. The lower wall 128 is provided with a pair of annular grooves 136 (see FIG. 8) in which respective O-rings 138 (see FIG. 6) are installed to seal the interface of the respective housings 18 and 42 against leakage of water through opening 134 and into the hull.

Preferably the opening 40 (see FIG. 1A) in the horizontal hull section 12 closely matches the opening in mounting plate. As seen in FIG. 2A, the housing 42 is bolted to the inlet housing 18 by studs 140. The shift and steering control housing 42 has throughholes 142 at respective corners (see FIG. 5). The studs 140 are threaded into respective threaded holes 144 formed in the top wall of the inlet housing 18 (see FIG. 4).

Figure 6:
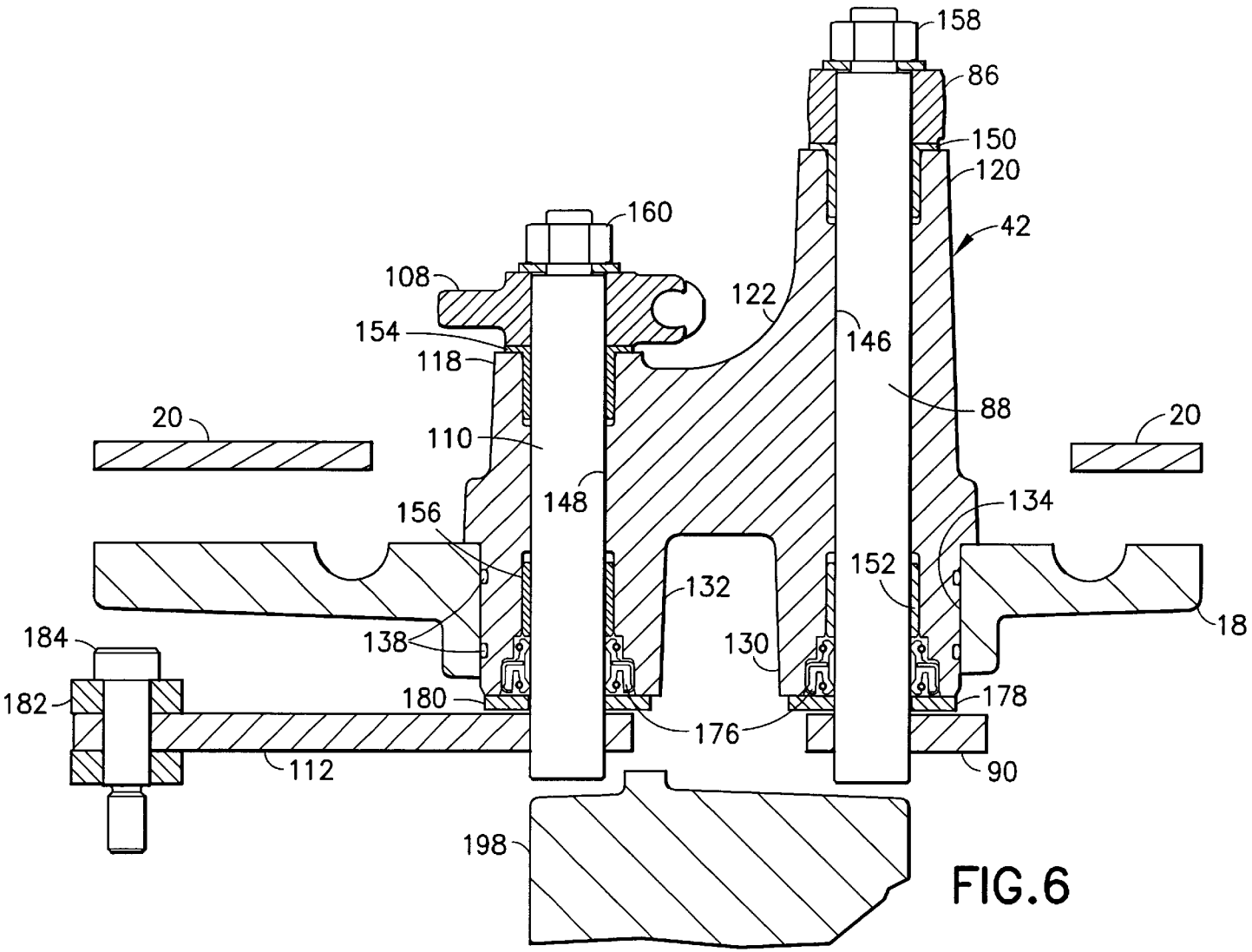
FIG. 6 is a schematic showing a sectional view taken along line 6—6 shown in FIG. 2A.

As best seen in FIG. 6, the shift and steering control housing 42 has one bore 146 for receiving the shift shaft 88 and another bore 148 for receiving the steering shaft 110. The bore 146 has upper and lower annular recesses in which upper and lower bushings 150 and 152 are respectively inserted; the bore 148 has upper and lower annular recesses in which upper and lower bushings 154 and 156 are respectively inserted. The shift shaft 88 is rotatably supported in bushings 150 and 152, while steering shaft 110 is rotatably supported in bushings 154 and 156. One end of the upper shift lever 86 is secured to the top of the shift shaft 88 by means of a lock nut 158 which screws onto a threaded end of the shift shaft; one end of the upper steering lever 108 is secured to the top of the steering shaft 110 by means of a lock nut 160 which screws onto a threaded end of the steering shaft. (Only a portion of each of the upper levers is shown in FIG. 6.) The upper levers bear on the flanges of the upper bushings during rotation of the lever and shaft assemblies.

The upper shift lever has a D-slot which form fits on a portion of the shift shaft having a D-shaped cross section. Referring to FIG. 2A, the upper shift lever 86 has a pair of opposing fingers which are pinched together by a screw 172, the resulting compressive force clamping the upper shift lever 86 to the shift shaft 88. The upper steering lever 108 has a similar construction, with fingers pinched together by a screw 174 to clamp the upper steering lever to the steering shaft. Alternatively, the shift and steering levers can be stampings retained by washers and nuts, with the "pinch" fingers being eliminated.

Referring to FIG. 6, the reference numeral 176 designates a pair of seals installed in annular recesses formed at the bottom of the respective lower vertical tubular structures 130 and 132, in surrounding relationship with the shift and steering shafts respectively. A lower shift lever 90 is welded to the bottom of the shift shaft 88, while a lower steering lever 112 is welded to the bottom of the steering shaft 110. A lower washer 178 is installed between the lower shift lever 90 and the lower vertical tubular structure 130 of the shift and steering control housing 42, while a lower washer 180 is installed between the lower steering lever 112 and the lower vertical tubular structure 132 of housing 42. The washers 178 and 180 provide for rotation.

The full length of the lower steering lever 112 is shown in FIG. 6, while only a portion of the lower shift lever 90 is depicted. FIG. 6 shows a clevis 182 and a shoulder screw 184 for attaching the distal end of the lower steering lever 112 to the forward end of the steering rod (not shown in FIG. 6). Similarly, the distal end of the lower shift lever is attached to the forward end of the shift rod by means of a clevis and shoulder screw coupling (not shown in FIG. 6).

Referring to FIG. 2A, the distal end of the upper shift lever 86 is attached to the shift cable assembly 82 by means of a clevis 186 and a clevis pin 188. These components are located inside the hull of the boat (see FIG. 1A). Displacement of the end of shift cable assembly 82 causes the shift lever and shaft assembly to rotate. Likewise the distal end of the upper steering lever 108 is attached to the steering cable assembly 78 by means of a clevis 190 and a clevis pin 192, and displacement of the end of steering cable assembly 78 causes the steering lever and shaft assembly to rotate. In response to operation of the steering cable assembly 78, the steering nozzle can be selectively turned left or right to steer the boat as desired during water jet operation. In response to operation of the shift cable assembly 82, the reverse gate can be selectively raised or lowered to propel the boat forward or rearward as desired during water jet operation.

Figure 9:
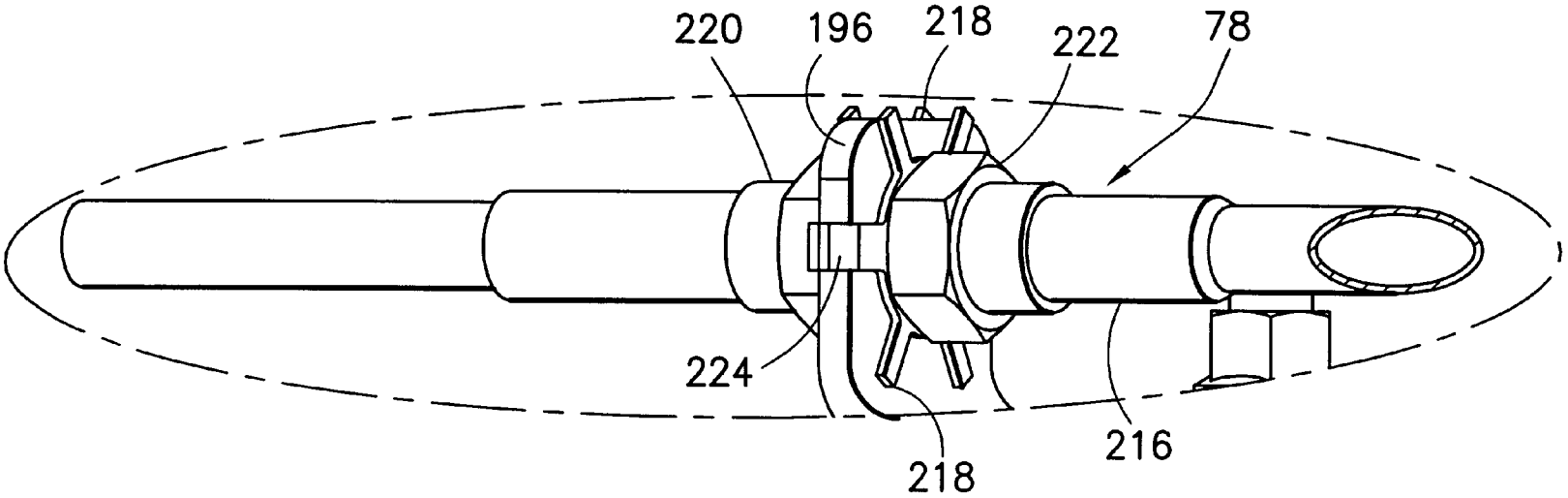
FIGS. 9 and 10 are schematics showing isometric and top views of a portion of a steering cable assembly which is mounted to the top mounting plate in accordance with the preferred embodiment of the invention.
Figure 10:
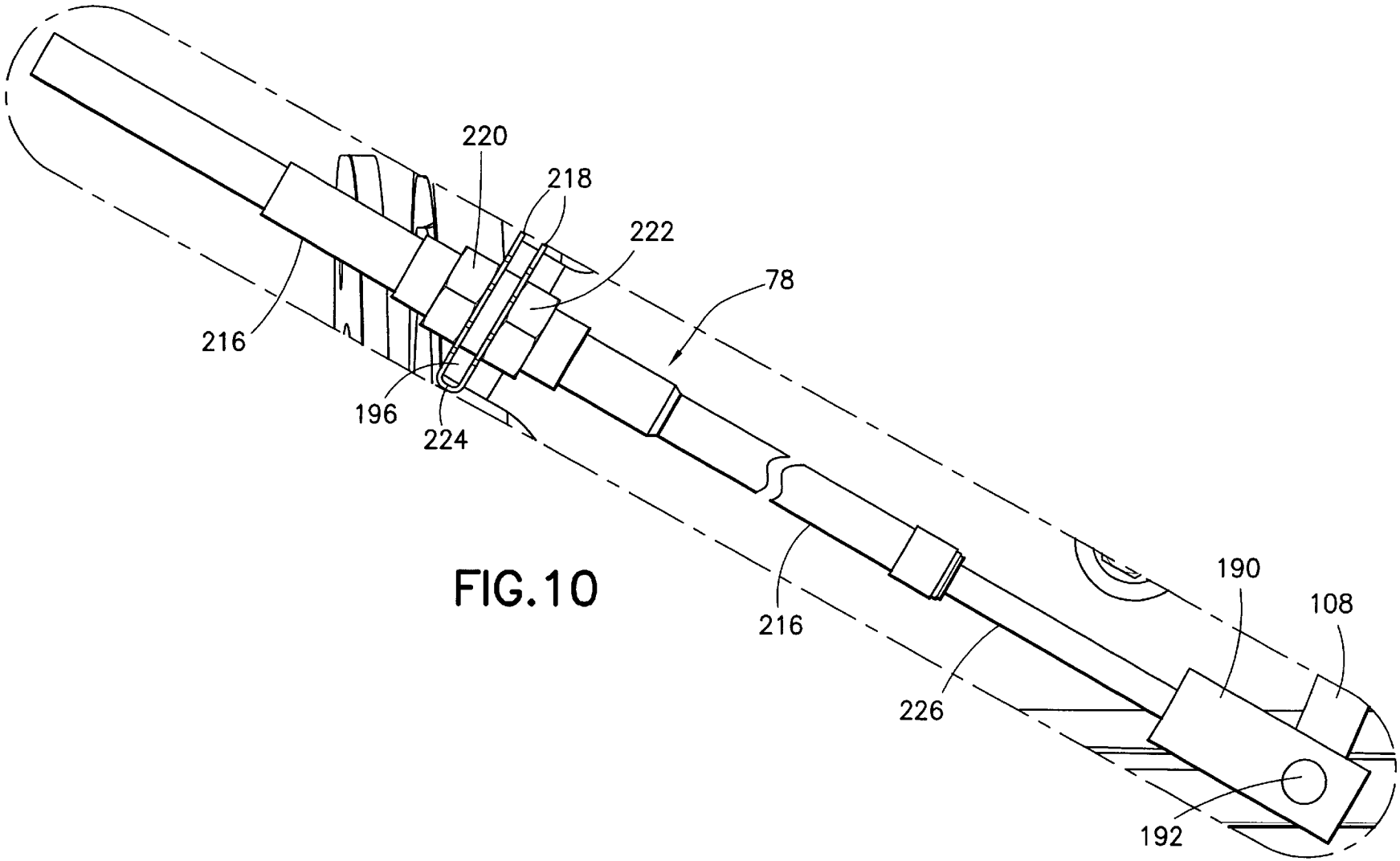

As seen in FIG. 1A, the shift cable assembly 82 is supported by a bracket 194 and the steering cable assembly 78 is supported by a bracket 196, both brackets being integrally connected to and extending vertically upward from the top mounting plate 20. The structural details of the preferred mounting arrangement are shown in FIGS. 9 and 10 for the steering cable assembly. An identical arrangement is employed to mount the shift cable assembly to the top mounting plate.

Referring to FIGS. 9 and 10, the steering cable assembly 78 comprises a steering cable housing 216 which is mounted to the mounting bracket 196 by means of a pair of connected tabbed washers 218 and a pair of threaded nuts 220 and 222. The threaded nuts 220 and 222 are respectively threadably coupled to oppositely threaded threads on the exterior of the steering cable housing. One tabbed washer of washer pair 218 is sandwiched between threaded nut 220 and a surface of the mounting bracket 196. The other tabbed washer of washer pair 218 is sandwiched between threaded nut 222 and the opposite surface of the mounting bracket 196. The tabbed washers are connected by a U-shaped member 224. A steering cable (not visible in FIGS. 9 and 10) is slidably arranged inside the steering cable housing. One end of the steering cable is coupled to the steering mechanism (e.g., a steering wheel in the cockpit), while the other end of the steering cable is connected to one end of a coupling rod 226. The other end of the coupling rod 226 is coupled to the upper steering lever 108 by means of the clevis 190. Thus, the upper steering lever 108 can be pivoted by sliding the steering cable inside the steering cable housing 216.

The foregoing structure is designed to facilitate installation of a shift and steering control system which penetrates a horizontal hull section of a boat. The assembly procedure is as follows. The lower levers are welded to the bottom ends of the respective shift and steering shafts. These welded lever and shaft subassemblies are then inserted in a large opening in the inlet housing, the bottoms of the shafts being supported by a boss 198 (seen in FIG. 5). As part of the assembly, grease is applied to both shafts. Then a pair of O-rings are installed in the annular grooves of the shift and steering control housing 42. One of the shaft is then placed in position in the opening in the inlet housing and the corresponding bore (146 or 148) of the shift and steering control housing 42 is slid over the top part of that shaft. Then the second shaft is passed up through the inlet housing and its top section is slid into the other bore, following which the housing 42 is slid downward and into the receiving opening in the inlet housing 18. In the final position, the housing 42 is bolted to the inlet housing 18. Then the upper shift lever 86 is assembled to the shift shaft 88. The upper steering lever is not pre-assembled to its shaft to allow assembly of the inlet housing to the hull. Therefore, means are provided for retaining the steering shaft and lower steering lever subassembly in the housing 42, either temporarily or permanently, until the upper steering lever 108 is installed in the boat.

After the shift and steering control housing has been attached to the inlet housing, the inlet housing is installed in the cavity behind the generally vertical hull section and under the horizontal hull section. During inlet housing installation, the front plate 22 is placed on the inside of the vertical hull section 14 and the inlet housing 18 is placed on the outside of vertical hull section 14, a set of three throughholes in the vertical hull section 14 and a set of three threaded holes 206 (seen only in FIG. 3) in the inlet housing 18 being aligned with a set of three throughholes in the vertical hull section 14. Three screws 24 (only one of which is visible in FIG. 1) are passed through the aligned throughholes and screwed into the threaded holes 206 of the inlet housing 18. The studs 28 are affixed to the inlet housing 18. The inlet housing 18 is inserted into the hull cavity and the studs 28 are inserted into throughholes in the hull. The front plate 22 is then positioned and screws 24 are screwed into the inlet housing 18. The top mounting plate 20 is then placed over the studs 28 and secured to the hull using nuts and washers.

After the inlet housing is installed with the shift and steering control housing projecting inside the hull, one end of the upper steering lever 108 is connected to the top of the steering shaft 110. Then the steering cable assembly 78 is installed and connected to the upper steering lever 108, as shown in FIG. 2A. Installation of the steering cable assembly will be described with reference to FIGS. 9 and 10, with the understanding that the shift cable assembly is installed in a similar manner.

During steering cable assembly installation, the tabbed washer pair 218 is slid onto the mounting bracket 196 with tabbed washers on opposing sides of the bracket and with the washer openings in alignment with the mounting bracket opening. Then the cable housing 216 is passed through the aligned openings and positioned so that the external threads of the cable housing 216 are on opposite sides of the mounting bracket 196. The forwardmost nut 220 is installed on the cable housing prior to installing in mounting bracket 196. The nut 222 is threaded onto the cable housing from the opposite side and tightened until the cable housing is secured to the mounting bracket. Although not shown in FIGS. 9 and 10, the tabs on the tabbed washers are folded down into abutment with respective facets of the threaded nuts, thereby locking the rotational position of the threaded nuts. Because the tabbed washers are connected by U-shaped member 224, the tabbed washers cannot rotate relative to each other. When the tabs are folded so that the tabbed washers are respectively interlocked with the threaded nuts 220 and 222, the tabbed washer pair 218 serves to lock the threaded nuts in rotational position, thereby preventing loosening of these nuts. After the steering cable assembly 78 has been attached to the mounting bracket 196, the end of the coupling rod 226 of the steering cable assembly is connected to the clevis 190.

Preferably the inlet housing and shift and steering control housing are made of sand-cast aluminum or molded plastic, the top mounting plate is made of carbon steel and the front plate is made of aluminum.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "outlet housing" comprises one or more attached parts. For example, in the disclosed preferred embodiment, the stator housing and the exit nozzle form an outlet housing. However, the present invention encompasses forming the stator housing and the exit nozzle as one piece, or forming the stator housing as two pieces, and so forth. In addition, although the preferred embodiment shows a horizontal hull section 12 and a nearly vertical hull section 14, it will be appreciated that the former may be nearly horizontal and the latter may be vertical. As used in the claims, the terms "generally horizontal hull section" and "generally vertical hull section" mean a horizontal or nearly horizontal hull section and a vertical or nearly vertical hull section respectively.

What is claimed is:

1. A marine craft comprising:

a hull comprising a generally horizontal hull section, and first, second and third hull sections connected to said generally horizontal hull section, said second hull section being connected to said first and third hull sections, said hull sections defining a cavity which is open at the bottom and at the rear;

an inlet housing installed in said cavity, said inlet housing comprising a top section in abutment with one surface of said generally horizontal hull section and a front section in abutment with one surface of said second hull section, wherein said inlet housing comprises a water tunnel having an inlet and an outlet;

a top mounting plate installed inside said hull in abutment with another surface of said generally horizontal hull section, said one and another surfaces of said generally horizontal hull section being on opposite sides of said generally horizontal hull section;

a front plate installed inside said hull in abutment with another surface of said second hull section, said one and another surfaces of said second hull section being on opposite sides of said second hull section;

a first set of fasteners for fastening said top mounting plate, said generally horizontal hull section and said top section of said inlet housing together; and a second set of fasteners for fastening said front plate, said second hull section and said front section of said inlet housing together.

2. The marine craft as recited in claim 1, wherein said front section of said inlet housing has a first cavity, said second hull section is a generally vertical hull section having an opening which communicates with said first cavity, and said front plate has an opening which communicates with said first cavity via said opening in said generally vertical hull section.

3. The marine craft as recited in claim 2, further comprising a drive shaft having an axis, wherein said inlet housing comprises a bore for receiving a first portion of said drive shaft, said bore communicating with said first cavity, and a second portion of said drive shaft residing in said first cavity.

4. The marine craft as recited in claim 3, wherein said inlet housing further comprises a rear section in which said water tunnel outlet resides, further comprising:

an outlet housing attached to said rear section of said inlet housing, said outlet housing comprising a water tunnel in flow communication with said water tunnel of said inlet housing; and an impeller mounted on a third portion of said drive shaft and residing in said outlet housing.

5. The marine craft as recited in claim 4, wherein said top section of said inlet housing has a second cavity, said generally horizontal hull section has an opening which communicates with said second cavity, and said top mounting plate has an opening which communicates with said second cavity via said opening in said generally horizontal hull section.

6. The marine craft as recited in claim 5, further comprising:

a steering nozzle pivotably mounted to said outlet housing; and a steering control system extending from inside said hull to said steering nozzle and penetrating said opening in said generally horizontal hull section.

7. The marine craft as recited in claim 6, wherein said steering control system comprises a steering cable assembly, further comprising a bracket which supports said steering cable assembly above said top mounting plate, said bracket being connected to said top mounting plate.

8. The marine craft as recited in claim 5, further comprising:

a reverse gate pivotably mounted to said outlet housing; and a shift control system extending from inside said hull to said reverse gate and penetrating said opening in said generally horizontal hull section.

9. The marine craft as recited in claim 8, wherein said shift control system comprises a shift cable assembly, further comprising a bracket which supports said shift cable assembly above said top mounting plate, said bracket being connected to said top mounting plate.

10. The marine craft as recited in claim 2, wherein said front section of said inlet housing has a front face with an endless recess located along a closed curve and facing said generally vertical hull section, said first cavity being located within the area bounded by said endless recess, further comprising a seal arranged in said endless recess for sealing the interface between said front face of said front section of said inlet housing and said generally vertical hull section.

11. The marine craft as recited in claim 5, wherein said top section of said inlet housing has a top face with an endless recess located along a closed curve and facing said generally horizontal hull section, said second cavity being located within the area bounded by said endless recess, further comprising a seal arranged in said endless recess for sealing the interface between said top face of said top section of said inlet housing and said generally horizontal hull section.

12. A water jet apparatus for mounting in a hull cavity defined in part by a generally horizontal hull section and a generally vertical hull section, comprising:

a drive shaft;

a monolithic inlet housing comprising a top section having a generally horizontal planar top surface, a front section having a generally vertical planar front surface, and a bore for receiving a first portion of said drive shaft, wherein said front section has a cavity and a plurality of threaded holes which have respective openings in said front surface, said cavity communicating with said bore and a second portion of said drive shaft residing within said cavity, and said top section has a plurality of threaded holes which have respective openings in said top surface.

13. The water jet apparatus as recited in claim 12, wherein said inlet housing comprises a water tunnel having an inlet and an outlet, said outlet being located in a rear section of said inlet housing, further comprising:

an outlet housing attached to said rear section of said inlet housing, said outlet housing comprising a water tunnel in flow communication with said water tunnel of said inlet housing; and an impeller mounted on a third portion of said drive shaft and residing in said outlet housing.

14. The water jet apparatus as recited in claim 12, wherein said front surface has an endless recess located along a closed curve, said cavity in said front section being located within the area bounded by said endless recess.

15. The water jet apparatus as recited in claim 12, wherein said top section has a cavity having an opening in said top surface, and said top surface has an endless recess located along a closed curve, said cavity in said top section being located within the area bounded by said endless recess.

16. An inlet housing for a water jet apparatus, comprising a water tunnel having an inlet and an outlet, a top section having a generally horizontal planar top surface, a front section having a generally vertical planar front surface and a portion of said water tunnel inlet, and a rear section having a rear surface and said water tunnel outlet, wherein said front section has a plurality of threaded holes which have respective openings in said front surface, said top section has a plurality of threaded holes which have respective openings in said top surface, and said rear section has a plurality of threaded holes which have respective openings in said rear surface.

17. The inlet housing as defined in claim 16, wherein said front section has a cavity with an opening in said front surface, further comprising a bore having first and second ends, said first end of said bore communicating with said cavity, and said second end of said bore being disposed at the center of said water tunnel outlet.

18. The inlet housing as recited in claim 17, wherein said front surface has an endless recess located along a closed curve, said cavity in said front section being located within the area bounded by said endless recess.

19. A marine craft comprising:

a hull comprising a generally horizontal hull section overlying a cavity;

an inlet housing mounted to said generally horizontal hull section, said inlet housing comprising a top section in abutment with one surface of said generally horizontal hull section, wherein said inlet housing comprises a water tunnel having an inlet and an outlet;

a top mounting plate installed inside said hull in abutment with another surface of said generally horizontal hull section, said one and another surfaces of said generally horizontal hull section being on opposite sides of said generally horizontal hull section; and a plurality of fasteners for fastening said top mounting plate, said generally horizontal hull section and said top section of said inlet housing together.

20. The marine craft as recited in claim 19, wherein said inlet housing further comprises a rear section in which said water tunnel outlet resides, further comprising an outlet housing attached to said rear section of said inlet housing, said outlet housing comprising a water tunnel in flow communication with said water tunnel of said inlet housing.

21. The marine craft as recited in claim 20, wherein said top section of said inlet housing has a cavity, said generally horizontal hull section has an opening which communicates with said cavity, and said top mounting plate has an opening which communicates with said cavity via said opening in said generally horizontal hull section.

22. The marine craft as recited in claim 21, further comprising:

a steering nozzle pivotably mounted to said outlet housing; and a steering control system extending from inside said hull to said steering nozzle and penetrating said opening in said generally horizontal hull section.

23. The marine craft as recited in claim 22, wherein said steering control system comprises a steering cable assembly, further comprising a bracket which supports said steering cable assembly above said top mounting plate, said bracket being connected to said top mounting plate.

24. The marine craft as recited in claim 21, further comprising:

a reverse gate pivotably mounted to said outlet housing; and a shift control system extending from inside said hull to said reverse gate and penetrating said opening in said generally horizontal hull section.

25. The marine craft as recited in claim 24, wherein said shift control system comprises a shift cable assembly, further comprising a bracket which supports said shift cable assembly above said top mounting plate, said bracket being connected to said top mounting plate.

* * * * *

UNITED STATES PATENT AND TRADEMARK OFFICE

CERTIFICATE OF CORRECTION

PATENT NO. : 6,238,256 B1
DATED : May 29, 2001
INVENTOR(S) : Michael W. Freitag

It is certified that error appears in the above-identified patent and that said Letters Patent is hereby corrected as shown below:

Title page,
Please change the filing date from "Dec. 22, 1999" to -- Dec. 24, 1999 --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*